US005702586A

United States Patent [19]

Pehrsson et al.

[11] Patent Number: 5,702,586

[45] Date of Patent: Dec. 30, 1997

[54] POLISHING DIAMOND SURFACE

[75] Inventors: Pehr E. Pehrsson, Alexandria, Va.; Michael L. Marchywka, Lanham, Md.

[73] Assignee: The United States of America as represented by the Secretary of the Navy, Washington, D.C.

[21] Appl. No.: 266,770

[22] Filed: Jun. 28, 1994

[51] Int. Cl.[6] ..... C25F 3/02; C25F 3/16

[52] U.S. Cl. ..... 205/640; 205/674; 205/683

[58] Field of Search ..... 205/665, 667, 205/640, 674, 683

[56] References Cited

U.S. PATENT DOCUMENTS 5,269,890 12/1993 Marchywka ..... 205/665

5,587,210 12/1996 Marchywka et al. ..... 205/668 X

*Primary Examiner*—Donald R. Valentine

*Attorney, Agent, or Firm*—Thomas E. McDonnell; George A. Kap

[57] ABSTRACT

Process of smoothing or polishing a diamond surface to reduce asperities thereon to a level as low as about 20 nm from the horizontal by implanting the diamond surface with ions to form a non-diamond carbon damage layer on or below the diamond surface below the disparity depth and dissolving the non-diamond carbon by submerging the non-diamond carbon in a liquid having sufficient electric field to dissolve the non-diamond carbon.

18 Claims, 2 Drawing Sheets

POLISHING DIAMOND SURFACE

FIELD OF THE INVENTION

This invention pertains to treating a diamond surface to remove or reduce asperities thereon.

BACKGROUND OF THE INVENTION

The recent explosive progress in deposition of adherent, conformal coatings of diamond by various chemical vapor deposition (CVD) processes has opened up the possibility of using diamond thin films as protective coatings in a large number of applications. These include uses for optics, electronics, x-ray lithography, tool bits and other wearing surfaces, and bioimplanation. Diamond is chemically and biologically inert, is the hardest material known, has excellent insulating and semiconducting properties when appropriately doped, has the best thermal conductivity known, and is optically transparent over a very wide wavelength range. Diamond grown by CVD techniques can be single crystal or polycrystalline, with typical crystal dimensions ranging from tens of nanometers to tens of microns. The top surfaces of the films composed of these particles are, therefore, rough since they consist of many facets of the individual crystals. Because diamond is the hardest known material, it is very difficult to remove the tops of the crystals and render the top surface of the films flat.

Many different approaches have been tried to polish a diamond. The traditional method used to polish natural diamonds is to place the crystal on a polishing lap impregnated with diamond grit. That method is very slow and expensive, leaves large polishing marks and grooves in the crystal face, and is restricted to flat surfaces, or at best, some very simple 3-dimensional shapes. This latter problem is acute and is a major impediment to further use in optics applications for other than flat surfaces.

Other approaches to polishing are to bring the diamond in contact with a rotating hot iron or other carbide-forming metal wheel under a hydrogen atmosphere. The carbon composing the diamond diffuses into the wheel, gradually wearing down the diamond. The limitations of that approach are obvious. High temperatures, large massive wheels in contact with the diamond, and the need for flat surfaces, as well as pullout, delamination, and uniformity variations all limit the utility of that technique.

Yet another approach is to erode away the diamond asperities by sputtering the surface with a high-energy ion beam, such as argon or oxygen. That approach, while applicable to large areas and irregular shapes, is extremely slow and expensive, and damages the surfaces of the crystals.

SUMMARY OF THE INVENTION

An object of this invention is a simple and a cheap process for polishing a non-planar or curved diamond surface to remove or reduce asperities or surface roughness thereof.

Another object of this invention is a simple and inexpensive technique for polishing or smoothing a natural or a synthetic diamond surface.

Another object of this invention is non-contact polishing a diamond surface by the use of ion implantation and electrochemical etching to smooth asperities on the diamond surface.

These and other objects of this invention are realized by obliquely ion implanting a diamond having asperities thereon to provide a damaged layer in the diamond and removing the damaged layer in order to polish or smooth the diamond.

DETAILED DESCRIPTION OF THE INVENTION

Figures 1, 2, 3:
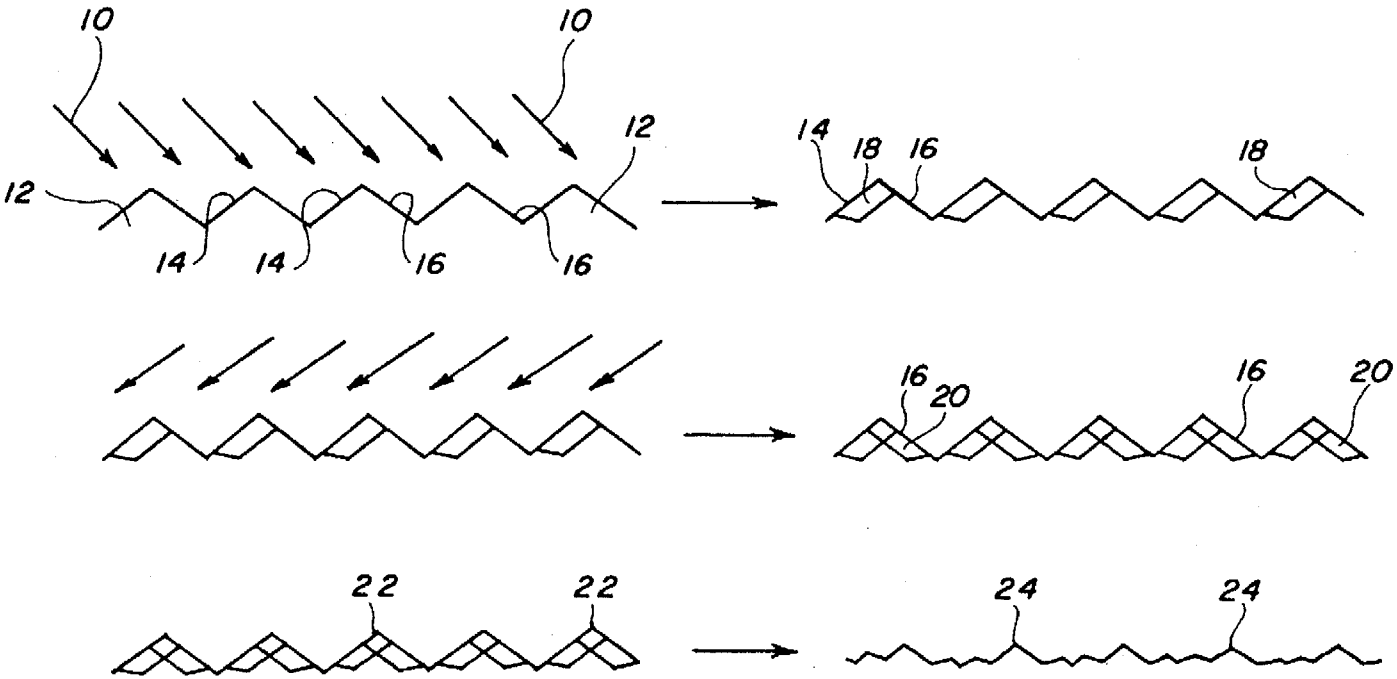
FIG. 1 is a schematic illustration of the polishing or the smoothing process of a diamond surface with the ion beam directed from left to right.
FIG. 2 is similar to FIG. 1 with the ion beam directed at the diamond surface from right to left.
FIG. 3 illustrates electrochemical etching of the ion-implanted diamond surface shown in FIG. 2.

The process begins by implanting a diamond at an oblique angle with high energy ions. The implantation energy can be easily varied and can be tailored to the size of the asperities to be leveled off on the diamond surface. The ion beam passes through the diamond for a distance proportional to the implantation energy and eventually comes to rest in a narrow band under the top surface of the diamond. As a result of implantation, this narrow band forms a damaged layer of non-diamond carbon. The energy is selected so that the damaged layer is well below the asperity depth. The damage is in a narrow buried zone in the diamond capped by a relatively undamaged cap layer of diamond. The damaged region is usually amorphous $sp^2$-type carbon. If the diamond is heated during implantation, the damage becomes more graphitic.

The buried damaged layer can be selectively removed in a non-contact electrochemical etch cell consisting of two electrodes immersed in a liquid with voltage applied between the electrodes. The diamond is disposed in the liquid between the electrodes. By subjecting the diamond to this process, the damaged layer can be etched away, undercutting the relatively undamaged cap layer on top, which then floats away from the diamond leaving behind a clean diamond surface which is essentially indistinguishable from the original diamond. The buried implanted damage layer underlying the rough surface is comparatively flat and featureless.

If a diamond is rotated under an oblique ion beam, a damaged layer is created under the asperities while the low points or valleys between asperities are shadowed by other asperities.

The peaks can be removed in successive stages by repeating the process at higher and higher angles as the asperities become flatter. Alternatively, the implantation depth can be deep enough that the asperities are removed in one implantation and etch cycle. Further smoothing of the surface can be again accomplished by implanting at shallow angles so as to minimize the damage layer thickness. Isolated, large asperities can be removed by shallow angle implantation, which introduces a flat implanted layer everywhere except the asperity, which is implanted from the side and then selectively etched away.

It should be realized that the asperities are randomly disposed on a diamond and vary in height, width and angular disposition. Faces of an asperity need not be planar but can be curved. Furthermore, the asperities can be disposed above or below the diamond surface.

The ion implantation beam directed normal to a face of an asperity will have maximum implantation thickness and, therefore, can remove a great deal of the asperity after an electrochemical etch. Such a beam, however, may not be desired. The beam directed normal to an asperity may be normal to one face of the asperity but may not be normal to another asperity. Such a normal beam may also provide a thicker band of damaged layer deeper in the diamond than desired. The deeper the band of damaged layer, the thicker will be the diamond cap layer disposed above the band of the damaged layer and the more diamond will be discarded after the etch.

For reasons noted above and for other reasons, a shallow angle with respect to the horizontal plane of the diamond is typically used when directing a beam of ions at a diamond having asperities on its surface. Since the ions will be impinging on the diamond at a shallow angle, the thickness of the damaged layer and the thickness of the diamond cap layer, both in the diamond and the asperities thereon, will be less than if the ions were directed at the diamond at a greater angle. Although the impinging angle will be below 90°, in the range of about 1° to about 80°, the shallow angle is typically 5° to 30° from one side or another of the horizontal.

The polishing process is more fully disclosed in connection with views of FIGS. 1, 2 and 3 wherein FIG. 1 shows ion beam represented by arrows 10 impinging at an oblique angle on diamond asperities represented by numeral 12 each with faces 14, 16. FIG. 1 shows ion beam 10 directed at an oblique angle at faces 14 of asperities 12.

In FIG. 1, damaged layers 18 are illustrated on faces 14 of asperities 12 after ion implantation. FIG. 1 does not show the diamond cap layers disposed above the damaged layers 18. In order to subject all the asperities on a diamond to ion implantation on all faces, the diamond can be rotated or turned in a horizontal plane under the oblique ion beam to create the damage layer that is subsequently removed. FIG. 2 illustrates creation of damaged layers 20 on faces 16 of asperities 12 after the ion beam and/or diamond are turned to a position at which the ions are impinging on faces 16 of asperities 12 at an oblique angle. FIG. 2 does not show the diamond cap layers disposed over the damaged layer 20.

After the diamond and asperities thereon have been ion implanted from all sides resulting in a band of damaged non-diamond carbon below the surface of the diamond and the asperities, the diamond is subjected to an electrochemical etch. The etch has the effect of dissolving or disintegrating the non-diamond carbon in the damaged layer and allowing the diamond cap layer to separate from the diamond with the asperities thereon and float away. This condition after etching is shown in FIG. 3.

In FIG. 3, apexes 22 of asperities before the etch are greater in vertical extent than apexes 24 of the same asperities after the etch.

Apexes 24 and other asperities can be removed in successive stages by repeating the process at larger and larger angles from the horizontal as the asperities become flatter and flatter. Alteratively, the implantation depth can be deep enough so that the asperities are removed in one implantation and etch cycle. If a smoother surface is desired thereafter, further smoothing can be accomplished by implanting ions at shallower angles from the horizontal to minimize the thickness of the damaged layers.

Figures 4, 5, 6:
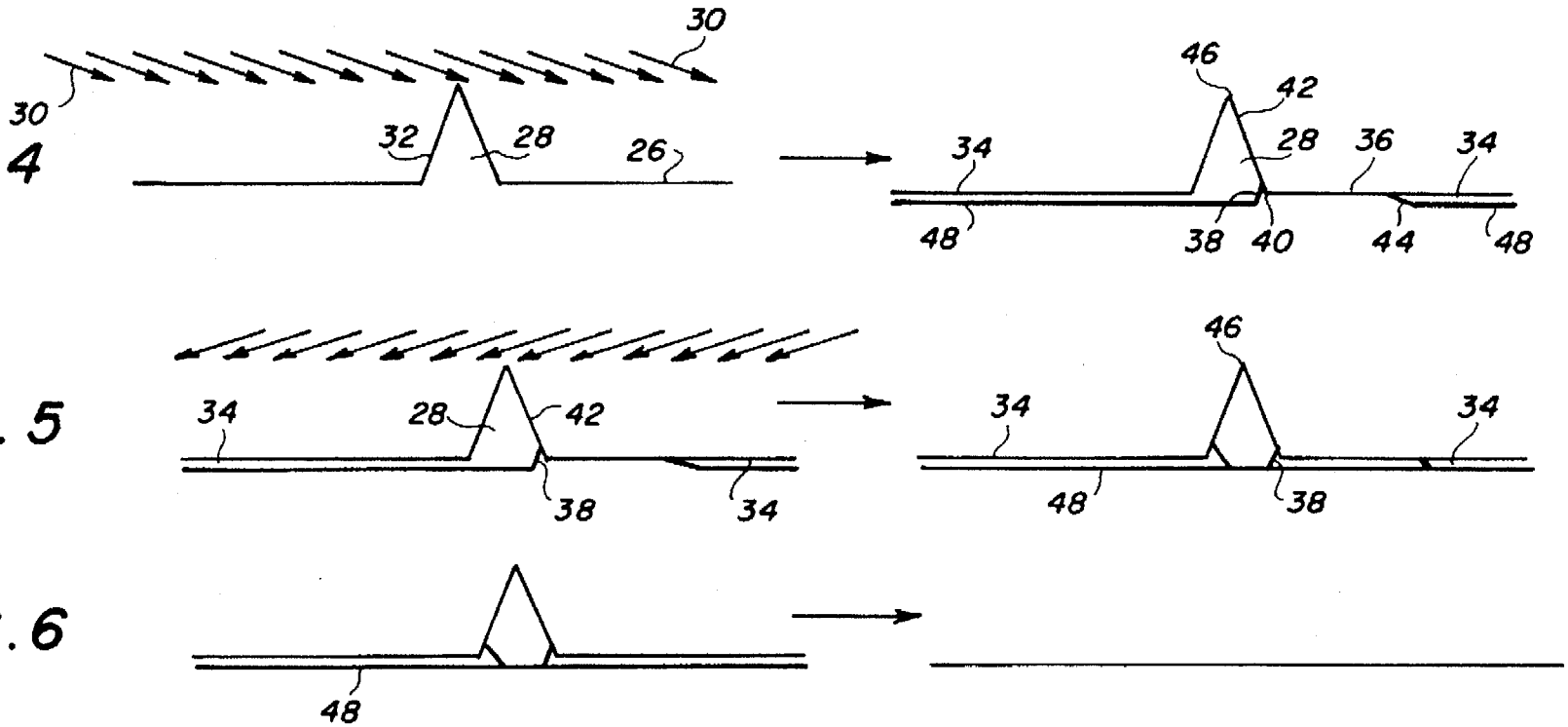
FIG. 4 is a schematic illustration of the polishing or the smoothing process applied to an isolated large diamond asperity.
FIG. 5 is similar to FIG. 4 with the ion beam directed in a direction opposite to that shown in FIG. 4.
FIG. 6 illustrates electrochemical etching of the ion-implanted diamond surface shown in FIG. 5.

FIGS. 4, 5 and 6 schematically illustrate smoothing a diamond surface 26 with an isolated large asperity 28 thereon. FIG. 4 shows ion beam represented by arrows 30 impinging on face 32 of asperity 28 at a small or shallow angle from the horizontal. The shallow angle of ion implantation means that ion implantation of an asperity will be substantial, although the implantation of diamond surface 26 will be relatively small. This difference results from the angle between face 32 of asperity 28 and the horizontal. This angle approaches a right angle as the asperity becomes larger or its implanted face becomes steeper. The shallow angle of ion implantation deposits a damaged layer 34 on diamond surface 26 with surface 36 of diamond surface 26 being blocked to angular implantation or by asperity 28. Damaged layer 34 is a non-diamond carbon layer created by the ion beam directed at the diamond surface 26 and represents the damaged layer of the diamond surface. The damaged surface 34 is a portion of diamond surface 26 and extends to angular line 38.

As should be apparent from FIG. 4, the portion of the asperity above lines 38 and 48 is mostly a non-diamond carbon layer created by ion implantation of the asperity. Line 38 is short and extends upwardly at an obtuse angle from line 48 to face 42 of asperity 28. Surface 36 extends horizontally from point 40 formed by its intersection with face 42 on the left and point 44 on the right. Point 44 marks initial impingement of the angular ion beam on the diamond surface over apex 46 of asperity 28. Surface 36, at this point in time, has not been exposed to the ion beam and, therefore, is the same as diamond surface 26 devoid of the non-diamond carbon damaged layer.

To expose surface 36 to the ion beam, the ion beam or the diamond surface 26 is rotated or turned to a position in which the ion beam rays impact surface 36. This position is illustrated in FIG. 5 where the ion beam is shown impacting face 42 of asperity 28 and surface 36 from an opposite direction shown in FIG. 4 at a shallow angle from the horizontal. By exposing unexposed surfaces to the angular beam, a damaged layer of non-diamond carbon is created on the diamond surface above horizontal line 48. This damaged layer of non-diamond carbon is removed by electrochemical etch, leaving a new diamond surface that is essentially free of asperities.

The energy and the angle of the ion beam is selected so that the damage layer is below the asperity depth and the new diamond surface is essentially flat, having a maximum surface variation of about 20 nm.

If the diamond surface is not sufficiently flat, ion implantation and electrochemical etching can be repeated a number of times to meet the desired requirements. Further smoothing of the diamond surface can be accomplished by implanting at shallow angles from the horizontal, thus minimizing the damage layer thickness on the diamond surface.

Ions for implantation according to the method of the present invention, include carbon, argon, boron, nitrogen, oxygen, beryllium, selenium, silicon, sulfur and zinc; especially carbon and argon. As should be apparent to a person skilled in the art, carbon is typically used since ion implantation with carbon does not introduce into diamond any atomic impurity.

Ions to be implanted are typically produced from a gaseous plasma mixture of ions and electrons although any suitable ion-generating means may be used. The ions are extracted from the plasma by a small electric field, accelerated and are usually passed through a strong magnetic field which allows separation and selection of a single ionic species having a narrow energy range. After the desired ions have been separated out, they are focused by electrostatic or magnetic lenses. The resulting ion beam is then directed at the diamond.

Nitrogen can be implanted in a diamond directly from plasma at low to moderate energy. This can be done by placing the diamond in the plasma and applying a voltage of about $10^4$–$10^5$ volts thereto. The ions are accelerated across a boundary layer surrounding the diamond and are implanted directly in the diamond. With this procedure, the implanted nitrogen layer is more uniform.

Ion implantation of a diamond is effected by a high velocity ion beam. Typical ion kinetic energies of the beams range from about $1\times10^4$ to about $1\times10^7$ eV. These energies result in ion implantation depths of from about 0 to about 5 microns. The minimum dose of ions is typically about $10^{15}$ ions/cm$^2$ and is more often in the range from about $10^{16}$ to $10^{\circ}$ion. Irreversible and non-annealable damage can ensue when employing excessive ion doses. The duration of implantation is typically in the range of about 1 minute to about 5 hours, especially in the range of about 5 minutes to about 2 hours.

The ion current and its duration determine the amount of the ions that are implanted whereas the energy and the bulk of the ions determine the average depth of the implant.

Both the path of the ion beam and the target substrate are typically in a vacuum since ions are easily stopped in a gas.

Ion implantation creates structural defects in the diamond cap as the ions traverse the upper portion of the diamond. This damage is greater at the damaged layer of non-diamond carbon than it is in the diamond cap layer. In their traversal, the ions lose most of their kinetic energy through interactions with electrons and nuclei of the diamond and these interactions result in changes in their path directions. The structural defects created by ion implantation are mostly point defects as the ions are stopped by interactions with atoms in the cap or the top layer of the substrate. Atoms are dislodged from their original sites in the crystal lattice and moved into small interstices between the substrate atoms. After a large number of ions have been implanted in a diamond, the ions distribute themselves around a mean depth in a band that constitutes damaged layer or non-diamond carbon layer.

The thickness of the cap layer above the non-diamond carbon layer theoretically can be monolayer of carbon in diamond form, but typically it is about 10 nm or more, and more typically it is about 20–1000 nm and more typically about 20–500 nm. The maximum thickness will depend on the mass of the ions implanted and the duration and angle of implantation and the implantation energy. The minimum thickness of the non-diamond carbon layer can also theoretically be a monolayer, but typically it is a minimum of about 10 nm, typically in the range of about 20–1000 nm, more typically 20–500 nm. The maximum thickness of the non-diamond carbon layer will deepend on the implantation ion, implantation energy, implantation duration and angle of implantation.

If asperities on a diamond are such that they can be removed by mild ion implantation, the non-diamond carbon layer can be on the top surface of the diamond and the need for the diamond cap layer is obviated. However, for removal or reduction of other asperities in a single or a limited number of implantation and etch cycles, and for other reasons, implantation depth will be greater and there will be a diamond cap layer disposed above the non-diamond carbon.

The non-diamond carbon-layer is either graphite or amorphous carbon. Graphite is hexagonal carbon and it is crystalline, not amorphous. Whether one or the other is formed depends on the temperature of the diamond during ion implantation. If the diamond temperature is elevated during ion implantation, then a graphite layer can be formed. At lower temperatures, however, amorphous carbon layer is formed. At temperatures above about 1000° C., graphite is formed and at temperatures below about 1000° C., amorphous carbon is formed. A layer of non-diamond carbon may contain small amounts of other atoms depending on the implanted ions, e.g., nitrogen, carbon, argon, helium, iron, and the like.

Diamond can be doped by ion implantation with suitable atoms to create n-type and p-type semiconductors, although considerable lattice damage takes place when the impurity atoms are introduced into a diamond structure. Doping is typically carried out before creation of the damaged layer and before removal of the diamond cap layer. If too much damage is done, any subsequent annealing taking place graphitizes the diamond. If too little damage is done, the dopants end up in interstitial rather than substitutional sites after annealing. Diamonds of p-type are obtained by doping the diamond film typically with boron at a fluence of about $1\times10^9$ to $1\times10^{15}$ boron atoms/cm$^2$ at an energy of about $10^4$ to $10^7$ eV. Diamonds of n-type are obtained by doping the diamond film typically with phosphorous or lithium atoms at a fluence of about $1\times10^9$ to $3\times10^{15}$ atoms/cm$^2$ at an energy of about $10^4$ to $10^7$ eV.

Doping by ion implantation is very similar to ion implantation to create a damaged layer, described herein. In either case, the implanting beam consists of ions which become atoms once they are lodged in the substrate.

Annealing of the ion implanted diamond is optional and can be carried out to improve quality of the implanted region. Purpose of the annealing operation is to at least partially remove the damage caused by implantation. The anneal temperature can be about 500°–1500° C., but is more typically about 600°–1000° C., and is effected in an inert atmosphere or in a vacuum for a period of about 1–16 hours, typically about 3–8 hours. During the annealing operation, the black damaged layer acquires a tint if it is smooth. Annealing is typically performed after creation of the damaged layer but before removal of the diamond cap layer.

Once ion implantation is accomplished on a diamond to deposit thereon or therein a layer of non-diamond carbon, the diamond is placed in a liquid for electrochemical etching along the non-diamond carbon layer.

Electrochemical etching is disclosed in U.S. Pat. No. 5,269,890 of inventor M. J. Marchywka which issued Dec. 14, 1993. The entirety of that patent is incorporated herein by reference.

Separation of the diamond cap layer disposed over the damaged layer of the non-diamond carbon disposed some distance below the top surface of the diamond is effected by electrochemical etching which dissolves or disintegrates the non-diamond carbon layer under influence of an electric field. After the non-diamond carbon layer is dissolved or disintegrated, the diamond cap floats away from the diamond. In absence of the diamond cap layer, electrochemical etching merely removes the non-diamond carbon formed by ion implantation. Since the thickness of the non-diamond carbon layer on the asperities will be greater than on the diamond due to greater angle of ion impingement on the asperities, more of the asperities will be removed and the polishing process will thus progress.

Electrochemical etching used herein is characterized by subjecting an electrolyte to a voltage impressed between a pair of spaced electrodes with the diamond disposed therebetween. The impressed voltage provides an electric field in the electrolyte. The strength of the electric field in the electrolyte required to obtain optimum etching of the non-diamond carbon depends on the type of electrolyte employed, electrode spacing, electrode material, and other considerations. However, the electric field in the electrolyte is typically about 1–200 v/cm, and is more often about 10–100 v/cm. For a small separation of the electrodes, the impressed voltage that can supply the requisite electric field in the electrolyte is usually about 5–5000 volts, more typically about 10–1000 volts.

Suitable electrolytes for use in the electrochemical step include commercially available distilled water, aqueous solutions of acids such as chromic acid and boric acid, aqueous surfactant solutions, ammonium hydroxide, and strong acids such as sulfuric acid. Some of the electrolytes are nominally electrically nonconductive. Typically, dilute aqueous electrolyte solutions having a current density of about 1–100 ma/cm$^2$ at an impressed voltage of about 50–300 volts are used.

Although the electrodes which provide the electric field in the electrolyte may be made of any suitable electrically conducting material, the preferred material is carbon or a precious metal. 0f particular interest are electrodes made of platinum—iridium or graphite. The spacing between the electrodes should by sufficient to accommodate the implanted diamond therebetween and to obtain the necessary electric field strength, but should not be too great since etching rates are directly proportional to the spacing and the impressed voltage. Typically, the spacing between the electrodes is about 0.1–50 cm, and more typically about 0.5–20 cm. The etching rate is typically about 0.01 to 1 mm/min, and more typically 0.05 to 0.5 mm/min. Generally, etching is performed for about 1 minute to about 10 hours, and more typically for about one-half hour to about 5 hours from the time the diamond is placed into an electrolyte with the requisite electric field.

Electrochemical etching of the diamond assembly is carried out by placing the diamond into an electrolyte between spaced electrodes to create the requisite electric field in the electrolyte. The electric field in the electrolyte must be sufficient to etch or to dissolve or to disintegrate the damage layer of non-diamond carbon. When a portion of the substrate is observed to have been etched, the cathode can be moved to an unetched or lightly etched portion. Also, the diamond can be moved relative to the electrodes in order to obtain the desired etch or a more uniform etch. If the diamond surface is larger than the width of the electric field, the entire surface can be treated by moving one or both of the electrodes or moving the surface.

Dissolution of the non-diamond carbon allows any diamond cap above the non-diamond carbon to separate from the rest of the diamond. A smooth diamond, without any asperities, or with smaller asperities, remains. The process of the present invention can reduce asperities to about 20 nm in the vertical extent. The diamond surface under the etched region is essentially undamaged by the ion beam although there is a decrease in resistivity of the etch surface. This decrease in resistivity can be corrected by heating in a vacuum.

The foregoing description and discussion are merely meant to illustrate the principles of the instant invention and it not meant to be a limitation upon the practice thereof. It is the following claims, including all equivalents, which are meant to define the true scope of the instant invention.

What is claimed is:

1. A process for smoothing a diamond surface containing asperities thereon comprising the steps of:

(a) implanting ions in the diamond surface to form non-diamond carbon on the diamond surface and the asperities by directing an ion beam at an angle of less than 90° from the diamond surface, and (b) removing the non-diamond carbon by electrochemical etching.

2. The process of claim 1 wherein the thickness of the non-diamond carbon layer is below the depth of asperities.

3. The process of claim 2 wherein the step of implanting ions is accomplished with ion beam at an energy level of about $1\times10^4$ to about $1\times10^7$ electron volts.

4. The process of claim 3 wherein the diamond surface is curved and wherein the step of implanting ions is accomplished with ions selected from the group consisting of carbon ions, argon ions and mixtures thereof.

5. A product made by the process of claim 4.

6. The process of claim 1 wherein said step of removing is carried out by submerging the non-diamond carbon in a liquid under an electric field of sufficient strength to electrochemically etch the non-diamond carbon.

7. The process of claim 6 wherein the thickness of the non-diamond carbon layer is below depth of asperities; and wherein the step of implanting ions is accomplished with ion beam at an energy level of about $1\times10^4$ to about $1\times10^7$ electron volts.

8. The process of claim 7 wherein the liquid has a resistivity of of about 100 ohm-centimeters to about 10 megaohm-centimeters and the electric field in the liquid is about 1–200 v/cm.

9. The process of claim 8 wherein the electric field in the liquid is about 10–100 v/cm and wherein the liquid is selected from the group consisting of water, acid, ammonium hydroxide, aqueous surfactant solutions and mixtures thereof.

10. The process of claim 9 including the step of turning the diamond surface in reference to the implanting ions to form non-diamond carbon around the asperities.

11. The process of claim 10 wherein the liquid is selected from the group consisting of water and aqueous solutions of an acid and wherein the step of implanting ions is accomplished with ions selected from the group consisting of carbon ions, argon ions and mixtures thereof.

12. A product made by the process of claim 11 having a curved surface, the diamond surface being smooth to within at least about 20 nm surface variation.

13. A product made by the process of claim 9.

14. A process for polishing a diamond containing asperities thereon comprising the steps of:

(a) forming non-diamond carbon on the diamond and the asperities by directing an ion beam having an energy of about $1\times10^4$ to about $1\times10^7$ electron volts at the diamond at an angle of less than 90° with respect to the diamond;

(b) dissolving the non-diamond carbon disposed on the diamond and the asperities by submerging the non-diamond carbon in a liquid having an electric field of sufficient strength to remove the non-diamond carbon; and (c) turning the diamond to form non-diamond carbon around the asperities.

15. The process of claim 14 wherein the liquid has a resistivity of about 100 ohm-centimeters to about 10 megaohm-centimeters; wherein the electric field in the liquid is about 1–200 v/cm; and wherein the liquid is selected from the group consisting of water, acids, ammonium hydroxide, aqueous surfactant solutions and mixtures thereof.

16. The process of claim 15 wherein the liquid is selected from the group consisting of water and aqueous solutions of an acid; wherein the step of forming the non-diamond carbon is accomplished by directing an ion beam selected from the group consisting of carbon ions, argon ions and mixtures thereof at the diamond; and wherein the diamond has at least one non-planar surface having asperities thereon with the ion beam being directed at the asperity.

17. A product of the process of claim 16.

18. A product of the process of claim 14.

* * * * *